US005533430A

United States Patent [19]

Buch

[11] Patent Number: 5,533,430

[45] Date of Patent: Jul. 9, 1996

[54] APPARATUS FOR ARCHERY TARGET FORMATION AND INSERT THEREFOR

[76] Inventor: William L. Buch, R.R. 1, Box 788, Sabinsville, Pa. 16943

[21] Appl. No.: 288,818

[22] Filed: Aug. 11, 1994

[51] Int. Cl.[6] ..... B26D 3/06; B26D 7/10

[52] U.S. Cl. ..... 83/171; 83/651.1; 83/875; 219/228; 408/137

[58] Field of Search ..... 83/651.1, 171, 83/185, 646, 597, 662, 875; 219/221, 227, 228; 425/289, 295; 408/137, 102

[56] References Cited

U.S. PATENT DOCUMENTS

| | | | |
|---|---|---|---|
| 1,426,016 | 8/1922 | Smith | 83/651.1 |
| 2,300,699 | 11/1942 | Perry | 83/171 |
| 2,471,208 | 5/1949 | Gay | 408/137 |
| 3,762,709 | 10/1973 | Roloff et al. | 273/102 B |
| 3,968,711 | 7/1976 | Wilson | 83/171 |
| 4,042,240 | 8/1977 | Kinart | 273/102 B |
| 4,066,261 | 1/1978 | Stewart | 273/102 B |
| 4,077,301 | 3/1978 | Brahm | 83/651.1 |
| 4,082,473 | 4/1978 | Bratsos | 408/137 |
| 5,271,145 | 12/1993 | Westerman, Jr. et al. | 83/651.1 |

*Primary Examiner*—Rinaldi I. Rada
*Assistant Examiner*—Charles Goodman

[57] ABSTRACT

An archery target having a threaded bore directed medially thereof, with the archery target having a first density and an insert threadedly received within the target, having a second density at variance relative to the first density. An apparatus for effecting the cutting of a helical groove within the target block, such that a support yoke mounts an electrical heated resistance wire having a loop directed into the wire, whereupon rotation of the wire loop within a target block bore effects axial displacement of the cutting wire relative to the bore of the target block to impart a groove into the bore of helical configuration to threadedly receive the insert within the bore.

4 Claims, 5 Drawing Sheets

APPARATUS FOR ARCHERY TARGET FORMATION AND INSERT THEREFOR

TECHNICAL FIELD

The field of invention relates to target structure, and more particularly pertains to an insert arranged for selective replacement within a target block and an apparatus for construction of the target block to accommodate the insert.

BACKGROUND OF THE INVENTION

In the use of the archery apparatus, the archery blocks are formed of a polymeric foam construction permitting arrows of various types to be accommodated by such an archery target, wherein the instant invention attempts to overcome such deficiency by providing for an insert threadedly directed medially of the target block to accommodate arrows having various target and hunting type tips. Archery target construction is exemplified in U.S. Pat. Nos. 4,042, 240; 4,066,261 wherein a medially positioned plug is positioned within a layered target. U.S. Pat. No. 3,762,709 sets forth an archery target having a resilient shock-absorbing layer therewithin, and U.S. Pat. No. 3,476,390 sets forth an archery target having a layer therewithin.

SUMMARY OF THE INVENTION

The present invention relates to an archery target having an insert threadedly received medially of the target, with the insert being provided formed of various densities to accommodate archery and target type arrows. An apparatus for preparing a target is provided wherein a heated cutting wire is arranged to cut a helical groove within a target block opening to accommodate the insert in a threaded relationship.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
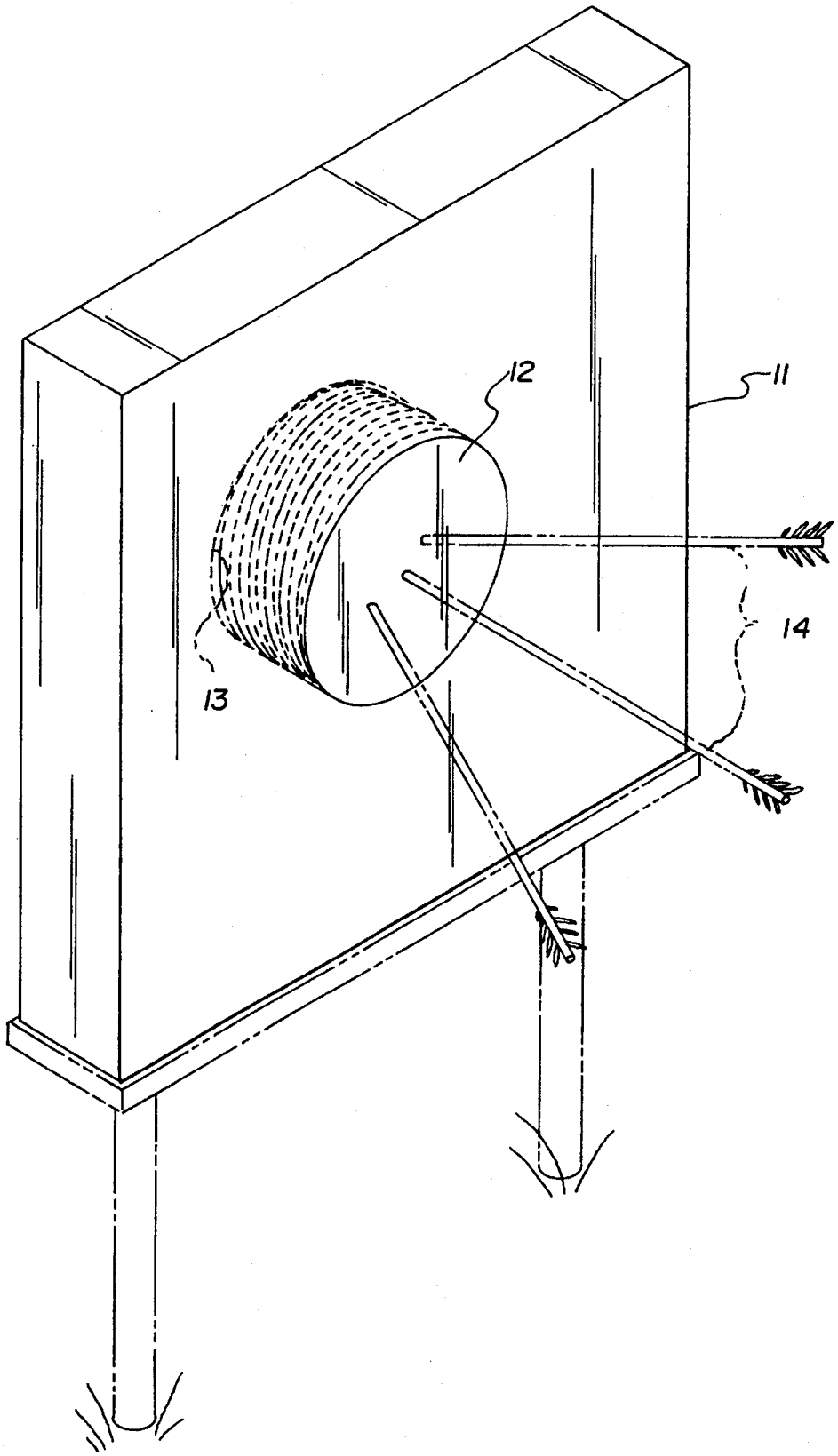
FIG. 1 is an isometric illustration of the archery target insert mounted within an associated archery target.

FIG. 1 indicates an archery target structure or block 11 pivotally formed of polymeric foam, having an internally threaded bore 13 to receive one of a plurality selectively of externally threaded plugs 12. The plugs 12 may be of various densities to accommodate various capacities such as associated archery arrows 14 to pierce the insert, wherein for example of higher density foam-like material may be employed relative to hunting arrows that have greater penetrating capacity than target arrows in use.

Figure 2:
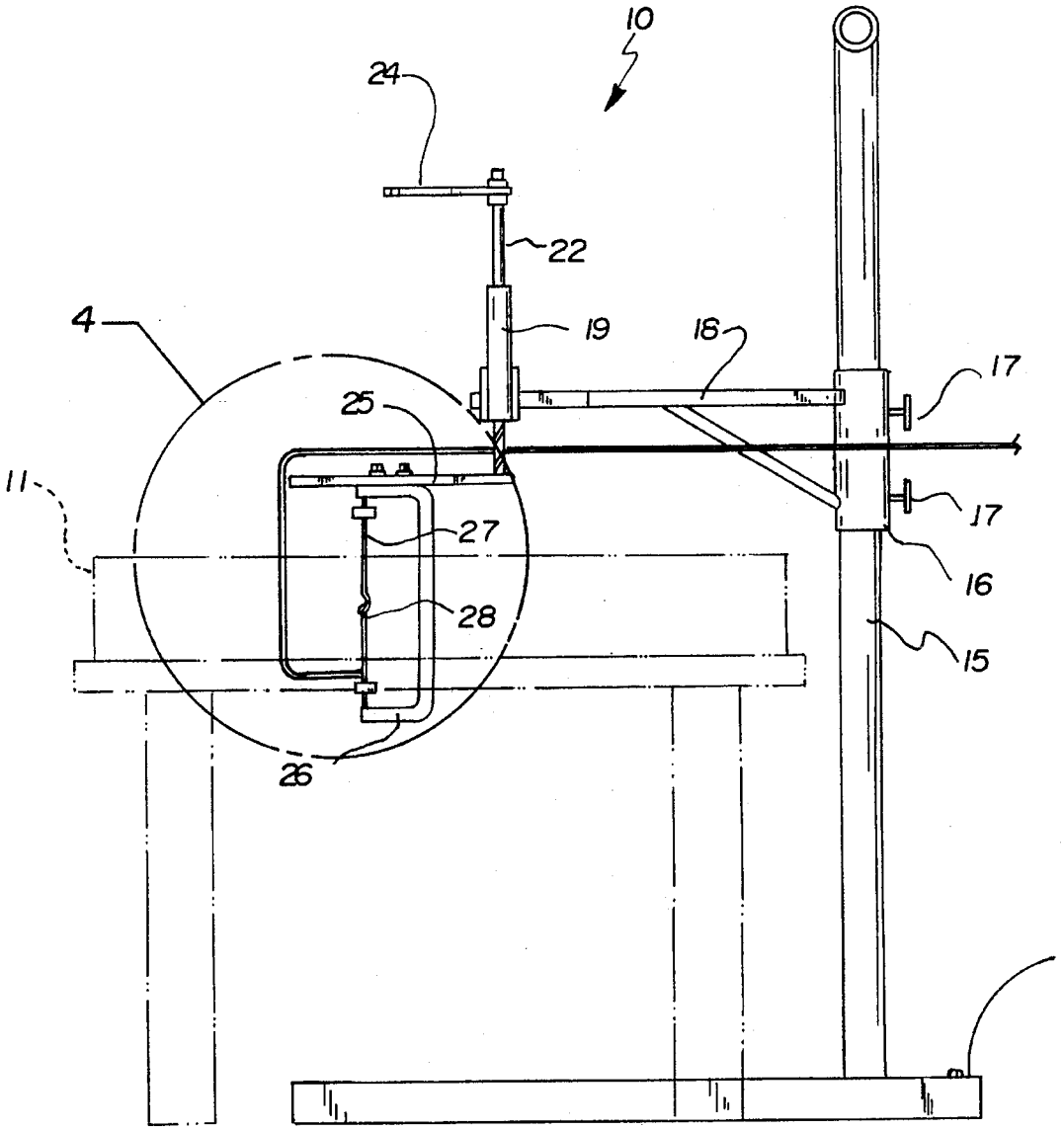
FIG. 2 is an orthographic side view of the apparatus arranged for preparing the archery target block.
Figure 3:
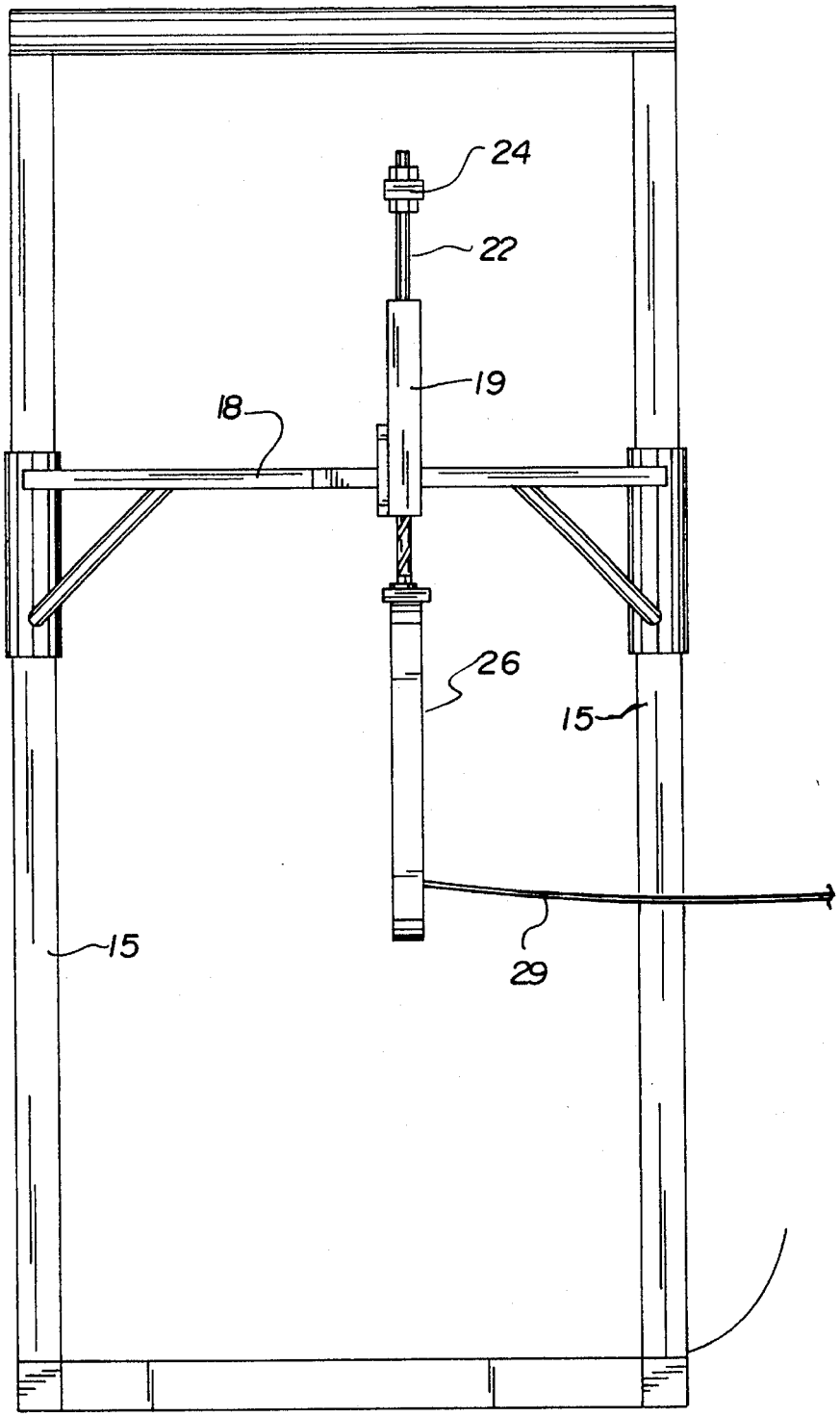
FIG. 3 is an orthographic frontal view of the apparatus as indicated in FIG. 2.
Figure 4:
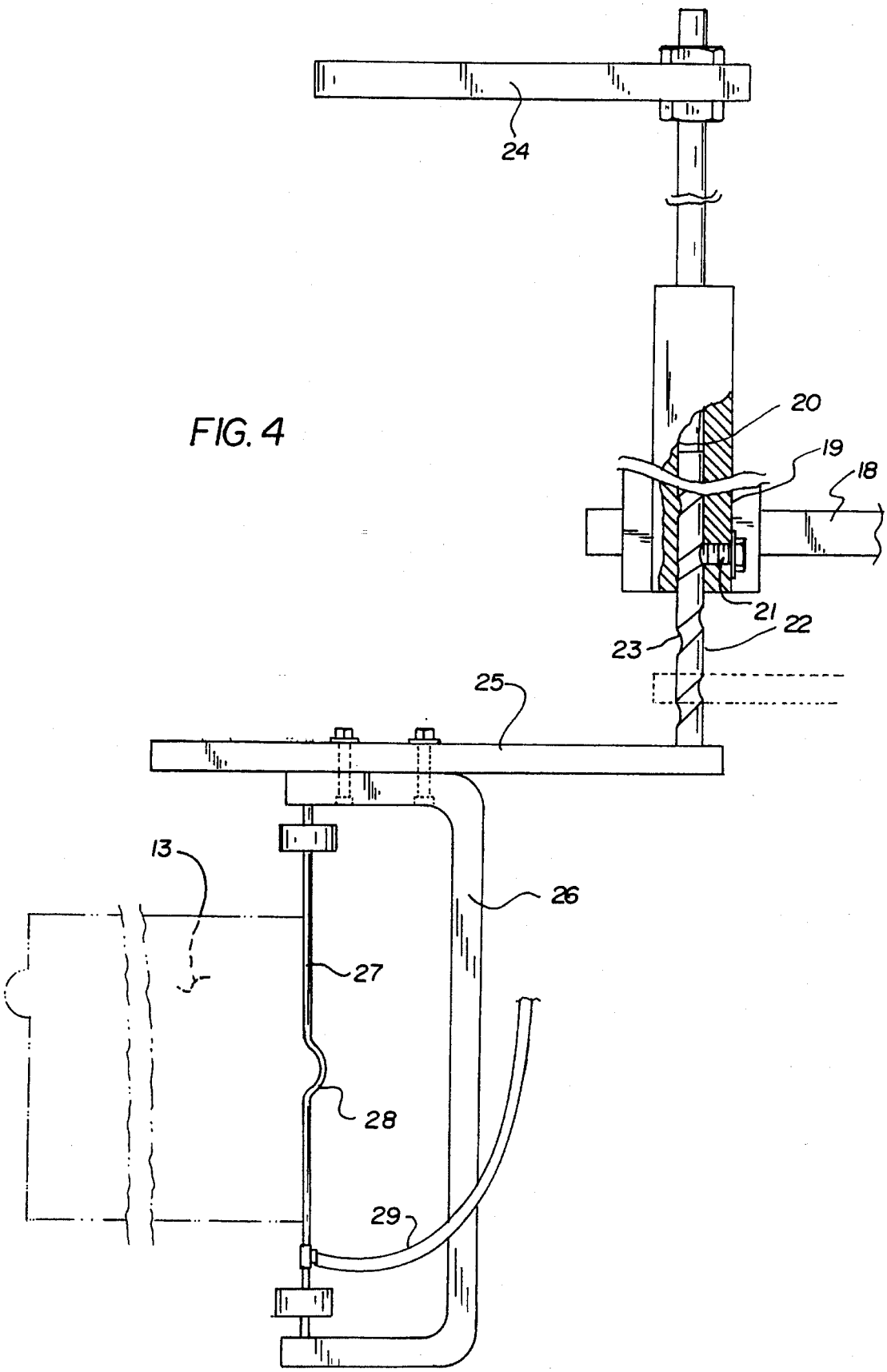
FIG. 4 is an enlarged orthographic view of section as set forth in FIG. 2.
Figure 5:
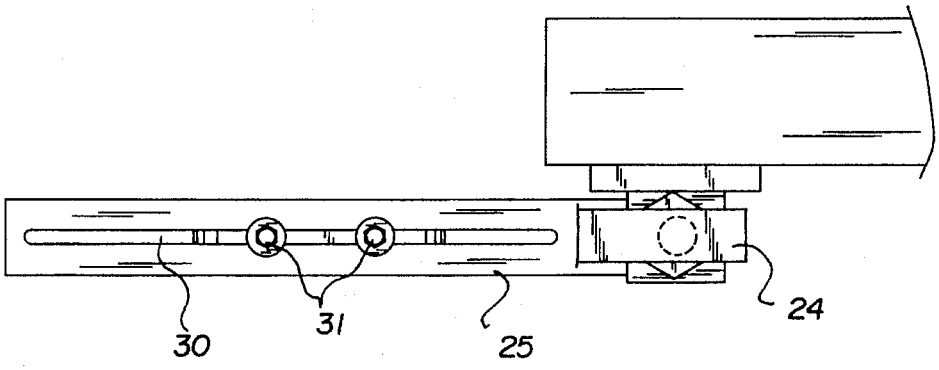
FIG. 5 is an orthographic top view of the apparatus as indicated in FIG. 4.
Figure 6:
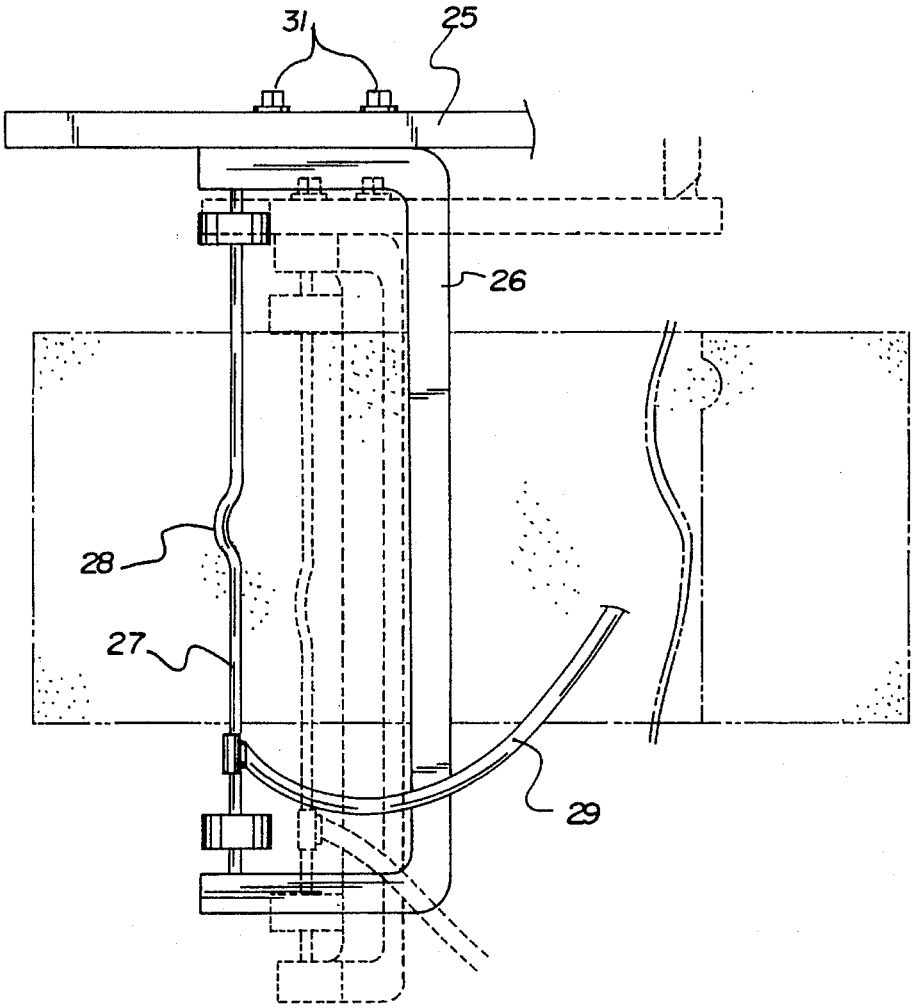
FIG. 6 is an orthographic view indicating the vertical displacement of the heated cutting wire in its cutting of a groove within a target block.

The apparatus 10 of the invention, as indicated in FIG. 2, sets forth a manner of shaping the archery block bore to impart a threaded groove therewithin to receive the insert 12. To this end, at least one or a plurality of support posts 15, as indicated in FIG. 3, are provided to each have a post sleeve 16. The post sleeves include sleeve fasteners 17 to affix in a vertically adjustable manner, the sleeve 16 relative to the individual post 15. A support shaft 18 orthogonally fixed to the sleeve 16 projects therefrom, such that the support shafts 18 where a plurality of support posts are utilized converge and are fixedly and orthogonally secured to a guide sleeve 19 at an outermost distal end of the support shaft 18. The guide sleeves 19 in this manner orthogonally affix to the support shaft 18 and includes a sleeve bore 20 orthogonally oriented relative to each support shaft 18. A guide pin 21 is directed through the guide sleeve 19 intersecting the guide sleeve bore 20, such that a rod 22 is rotatably directed through the guide sleeve bore 20, such that the rod 22 is formed with a helical groove 23, such that the helical groove 23 receives the guide pin 21 to insure that the rod 22 rotates as it is directed through the guide sleeve bore 20. A rod first end has a handle 2# affixed thereto, with a rod second end positioned at an opposed distal end of the rod 22 includes a second end plate 25 secured thereto. A support yoke 26 is adjustably mounted to the second end plate 25, wherein (see FIGS. 5 and 6) an elongate slot 30 is directed through the second end plate 25, such that slot fasteners 31 directed through the second end plate 25 and through the elongate slot 30 are secured to a support yoke 26 to adjustably direct the support yoke 26 along the second end plate 25. A cutting wire 27 that in turn may be heated as a resistance heating wire by an electrical heating conduit 29 is mounted to the support yoke 26, with the cutting wire 27 arranged in a substantially parallel relationship relative to the rod 22. The cutting wire 27 is formed with a wire loop 28, such that the wire loop imparts a threaded groove into the target block 11 when the cutting wire 27 is directed throughout the bore 13 of the block.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. An apparatus for forming a threaded groove in a target block bore, comprising:

at least one support post, said support post having a post sleeve, the sleeve being slidably directed along the support post, and fastening means for securing the post sleeve to the support post;

a support shaft orthogonally affixed to the post sleeve and extending therefrom;

and a guide sleeve fixedly and orthogonally secured to said support shaft spaced from said post sleeve, said guide sleeve having a guide sleeve bore with a rotation means directed therethrough, said rotation means mounting a support yoke having a cutting wire secured thereto, said cutting wire having a loop therein such that a rotation of the rotation means will effect vertical displacement thereof and will direct a helical groove into a target block as the support yoke is rotated within a target block;

said rotation means including a rod, said rod being slidably directed through said guide sleeve bore, a guide pin directed through the guide sleeve intersecting the guide sleeve bore, said rod having a helical groove with said guide pin being received within said helical groove such that upon rotation of the rod it effects rotation and vertical displacement relative to the guide sleeve within the guide sleeve bore.

2. An apparatus as set forth in claim 1 wherein the rod includes a first end having a handle affixed thereto, and a second end having a second end plate affixed thereto and mounting said support yoke.

3. An apparatus as set forth in claim 2 wherein the second end plate includes an elongate slot, with at least one fastener directed through the elongate slot secured to the support yoke adjustably mounting the support yoke along the second end plate.

4. An apparatus as set forth in claim 3 wherein the cutting wire includes an electrical conduit directed thereto to effect electrical heating of the cutting wire.

* * * * *